United States Patent [19]

Burtelson et al.

[11] Patent Number: 4,580,795

[45] Date of Patent: Apr. 8, 1986

[54] APPARATUS FOR INSTALLING ANCHORS

[75] Inventors: Frederick W. Burtelson, Harvard; Ronald G. Riley, Villa Park, both of Ill.

[73] Assignee: Joslyn Mfg. and Supply Co., Chicago, Ill.

[21] Appl. No.: 709,652

[22] Filed: Mar. 8, 1985

[51] Int. Cl.[4] ..... B23B 31/10; E02D 5/80

[52] U.S. Cl. ..... 279/1 R; 52/157; 279/76; 403/324; 403/325; 405/259

[58] Field of Search ..... 279/1 R, 76, 79, 110, 279/119, 1 TE; 52/157, 127.5, 155; 464/57, 125, 138; 405/259; 175/399; 403/315, 316, 320, 324, 325, 327, 328

[56] References Cited

U.S. PATENT DOCUMENTS

| | | | |
|---|---|---|---|
| 2,662,712 | 12/1953 | Rose | 403/325 X |
| 3,148,510 | 9/1964 | Sullivan | 52/157 X |
| 3,318,058 | 5/1967 | Sullivan | 52/157 |
| 3,377,077 | 4/1968 | Hollander et al. | 279/1 R |
| 3,832,860 | 9/1974 | Jahnke | 405/259 |
| 3,832,861 | 9/1974 | Jahnke et al. | 52/157 X |
| 4,334,392 | 6/1982 | Dziedzic | 52/157 |

*Primary Examiner*—William R. Briggs

*Attorney, Agent, or Firm*—Mason, Kolehmainen, Rathburn & Wyss

[57] ABSTRACT

Apparatus for installing anchors in the earth using rotational power and axial thrust from a power source includes an elongated torque tube for enclosing a guy rod of an anchor and having a lower end portion adapted to drivingly engage the hub of the anchor. A drive coupling is provided for detachably interconnecting the power source to drive the torque tube and install the anchor, and the coupling includes a body having a socket for receiving an upper end portion of the torque tube and an upper end portion of the guy rod. The socket has flatted side walls formed with radial ports which are positioned to face apertures that are provided in a torque tube which has been inserted into the socket. Lock pins are slidably mounted in the radial ports and are biased toward the center of the socket. The lock pins are adapted to project into the apertures of a torque tube when fully seated in the socket and also engage and hold the guy rod of an anchor as it is driven into the earth. The longitudinal position of the lock pins is controlled by cams which are pivotally mounted on outer end portions of the pins. Control handles are provided for moving the cams between disengaged, armed, and fully engaged operative positions and the handles provide a convenient visual indication of the position of the lock pins.

25 Claims, 9 Drawing Figures

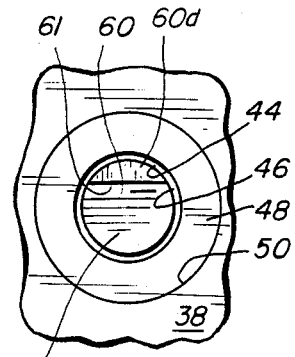
FIG. 8
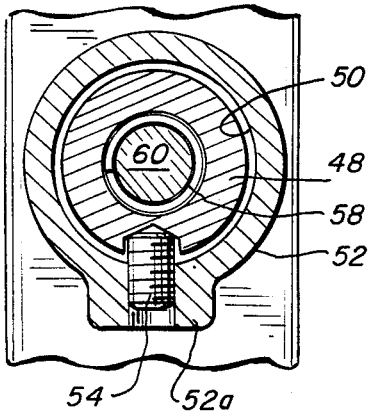
FIG. 9
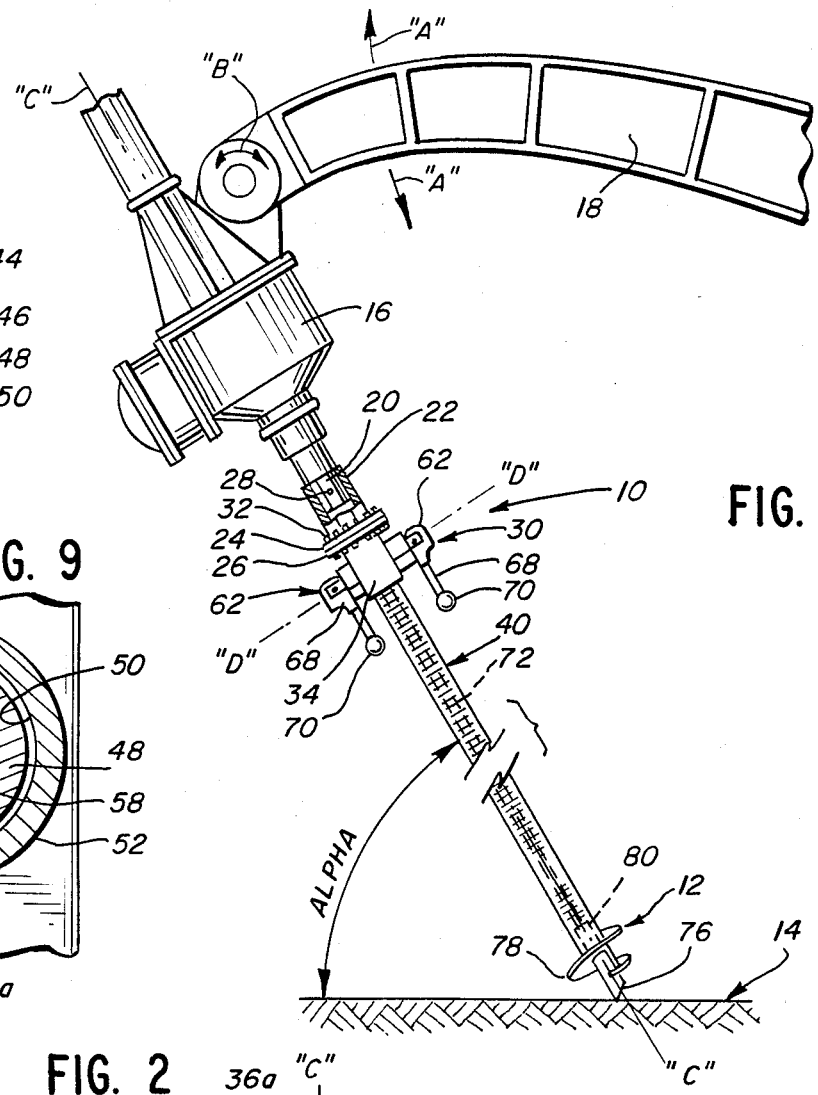
FIG. 1
FIG. 2
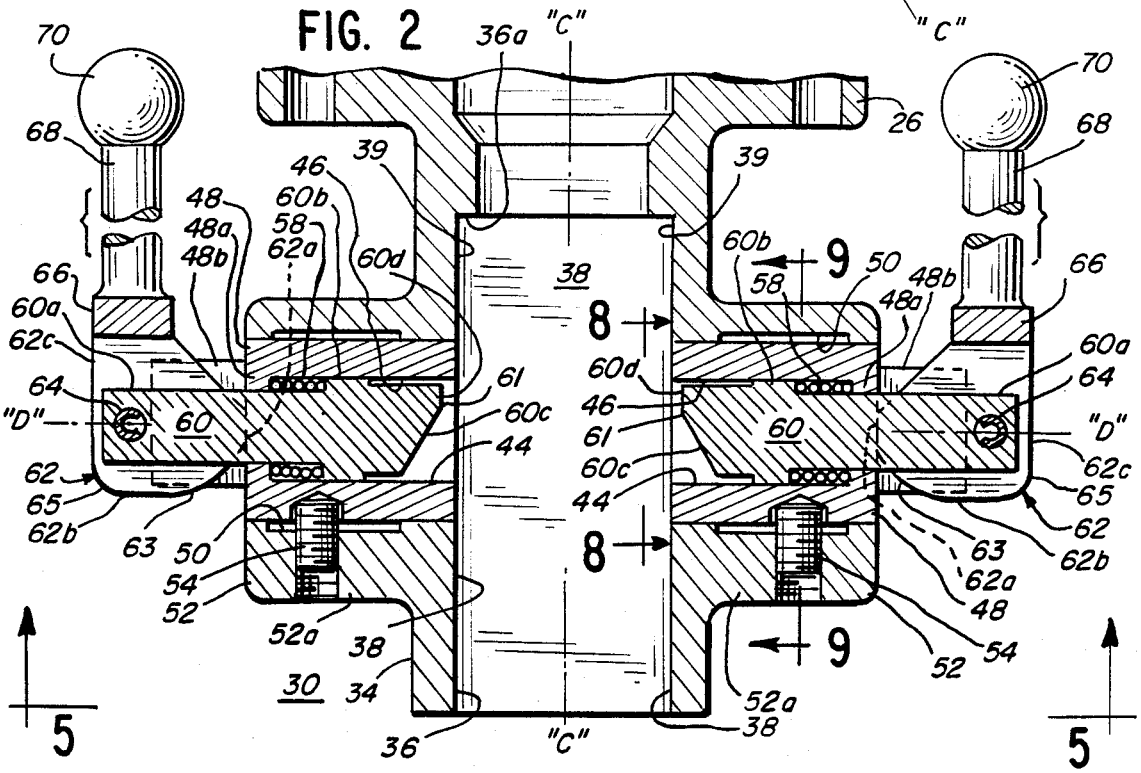

APPARATUS FOR INSTALLING ANCHORS

BACKGROUND OF THE INVENTION

1. Field of the Invention

The present invention relates generally to a method and apparatus for installing earth anchors and more particularly to a method and apparatus for installing earth anchors using a rotating power source for driving a torque tube through a drive coupling for detachably interconnecting the power source with the torque tube and an anchor being driven.

2. Description of the Prior Art

U.S. Pat. Nos. 3,832,860 and 3,832,861 disclose a method and apparatus for installing earth anchors. U.S. Pat. No. 3,148,510 discloses a method of installing earth anchors and U.S. Pat. No. 3,377,077 discloses a power installed screw anchor wrench. Other U.S. patents of interest are Widmer, No. 816,631; Lucas, No. 923,056; Kammerer, No. 2,758,891; Decker, No. 2,775,889; Yager, No. 3,525,225; Marcus, No. 3,529,460 and Petres, No. 3,828,562.

Many prior art systems for power driving screws anchors into the earth have disadvantages such as locking dogs which are difficult and cumbersome to advance and retract. Such prior art locking dogs make it difficult to secure a torque tube wrench and an anchor guy rod in place during installation and in addition make it difficult to release the anchor and torque tube after installation is completed.

Another disadvantage of prior art systems is the fact that it is often difficult to ascertain visually or otherwise whether or not the locking dogs are in a particular position such as an engaged position or a disengaged configuration for releasing the torque tube or the anchor, or both. Moreover, high values of force are often required in order to release the locking dogs after an anchor has been installed so that the torque tube may be withdrawn from the anchor. In addition, subsequently after withdrawal of the torque tube from a driven anchor it is some times difficult to get the torque tube released from the drive adaptor when desired.

OBJECTS OF THE INVENTION

It is therefore an object of the present invention to provide a new and improved method and apparatus for installing earth anchors, and more particularly, a new and improved method and apparatus for installing earth anchors using a power source providing rotational power and axial thrust.

It is an object of the present invention to provide a new and improved apparatus for installing earth anchors which includes cam controlled locking pins and control handles for positioning the cams and visually indicating the position thereof.

Yet another object of the present invention is to provide a new and improved apparatus for installing earth anchors employing cam lever handles which provide a mechanical advantage for positioning, engaging and retracting locking pins used for securing a torque tube and an anchor in place.

Yet another object of the present invention is to provide a new and improved apparatus for installing earth anchors which does not require twisting or turning of the lock pins and which permits a flat angular linear engagement between a torque tube and a flat surface of a lock pin upon insertion of the torque tube into an engaged position for driving an anchor.

Yet another object of the present invention is to provide a new and improved method and apparatus for installing earth anchors wherein insertion of a torque tube into a socket of a drive coupling automatically resets the lock pins into a condition ready for securing the guide rod of an anchor in place when the anchor is inserted into the torque tube ready to be driven.

Another object of the present invention is to provide a new and improved combination including an earth anchor, an elongated torque tube and a drive coupling for installing the anchor in the earth.

Yet another object of the present invention is to provide a new and improved drive coupling/torque tube adaptor of the character described which employs control handles for positioning spring loaded lock pins for securing a torque tube and anchor in place.

Yet another object of the present invention is to provide a new and improved coupling assembly/torque tube adaptor of the character described wherein the handles are operable to position spring loaded lock pins in a "disengaged", "armed" or "engaged" position.

Yet another object of the present invention is to provide a new and improved torque tube adaptor the character described wherein the handles provide a visual indication to the operator of the condition of the lock pins.

Yet another object of the present invention is to provide a new and improved apparatus of the character described wherein jarring or impact on an assembled together screw anchor and torque tube is effective to automatically position lock pins into an engaged position for holding a torque tube and anchor in coupled driving engagement with a rotary power source.

Yet another object of the present invention is to provide a new and improved method and apparatus for installing earth anchors which is fast, easy, and safe in operation and which is relatively low in cost in terms of both equipment and labor in comparison to prior art systems.

BRIEF SUMMARY OF THE INVENTION

The foregoing and other objects and advantages of the present invention are accomplished in a new and improved apparatus for installing earth anchors using rotational power and axial thrust from a power source. The anchors are of a type including a helical screw, a polygonal shaped hub above a screw flight, and an upwardly extending guide rod having a radial shoulder adjacent an upper end portion. The apparatus includes an elongated torque tube adapted to enclose the guide rod during installation and the torque tube has a lower end portion which is adapted to fit in driving engagement with the hub of the anchor as it is driven. An upper end portion of the torque tube is adapted to be driven from the power source and includes a radial port in a side wall thereof spaced from the upper end. A drive coupling is provided for interconnecting the torque tube, the anchor and the power source, and the coupling includes a body having an upwardly extending socket of polygonal shaped cross section for receiving the upper end portion of the torque tube in detachable, driving engagement. The body socket has flat side walls with a radial port therein positioned for alignment with the aperture of a torque tube when the torque tube is fully inserted into the socket. A radially moveable lock pin is mounted for axial movement in each port to move toward and away from the center of the socket between a plurality of radially spaced apart positions. A biasing spring is provided for urging each lock pin inwardly toward the center of the socket. The position of each lock pin is controlled by a cam pivotally mounted on an outer end portion of the pin and an outwardly extending control handle is adapted to move the cam between several operative positions and at the same time visually indicate the position of the lock pin.

When the handles are pivoted to an "up" position, the lock pins are restrained from extending into the socket and the pins are maintained in a "disengaged" condition so that a torque tube or a guy rod of an anchor can be freely inserted into or withdrawn from the coupling body without interference. With the handles in an outwardly extending, radial position, the lock pins are "armed" so that insertion of a torque tube upwardly into the socket is effective to momentarily bias the pins outwardly against the springs until alignment between the apertures of the torque tube and the lock pins is attained. When this occurs, the springs and the weight of the handles is effective to move the pins fully inwardly toward an "engaged" condition wherein the pins project into and through the apertures of the torque tube and wherein the handles are extending "downwardly". Subsequent insertion of a guy rod into the torque tube and upward movement of the anchor until the shoulder on the upper end thereof moves upwardly past the lock pins is effective to automatically reset the lock pins in an anchor retaining engagement for securing both the anchor and the torque tube firmly within the socket of the coupling body during installation. After installation of an anchor is completed, the handles may be moved back to the "armed" position to pivot the cams causing the lock pins to be retracted out of engagement with the shoulder surface of the guy rod. The torque tube can be withdrawn upwardly away from the installed anchor until well clear, and subsequent movement of the handles to the "up" position is effective to retract the lock pins from all engagement with the torque tube so that the torque tube may be withdrawn from the coupling socket.

BRIEF DESCRIPTION OF THE DRAWING

For a better understanding of the present invention, reference should be had to the following detailed description taken in conjunction with the drawings, in which:

FIG. 1 is an elevational view of a new and improved apparatus for installing an earth anchor in the ground constructed in accordance with the features of the present invention;

FIG. 2 is a longitudinally extending, cross-sectional view of a new and improved drive coupling assembly or torque tube adaptor constructed in accordance with the features of the present invention and illustrated in a "disengaged" position;

FIG. 8 is a fragmentary, inside elevational view looking in the direction of arrows 8—8 of FIG. 2, and FIG. 9 is a fragmentary, cross-sectional view taken substantially along lines 9—9 of FIG. 2.

DESCRIPTION OF A PREFERRED EMBODIMENT

Figure 3:
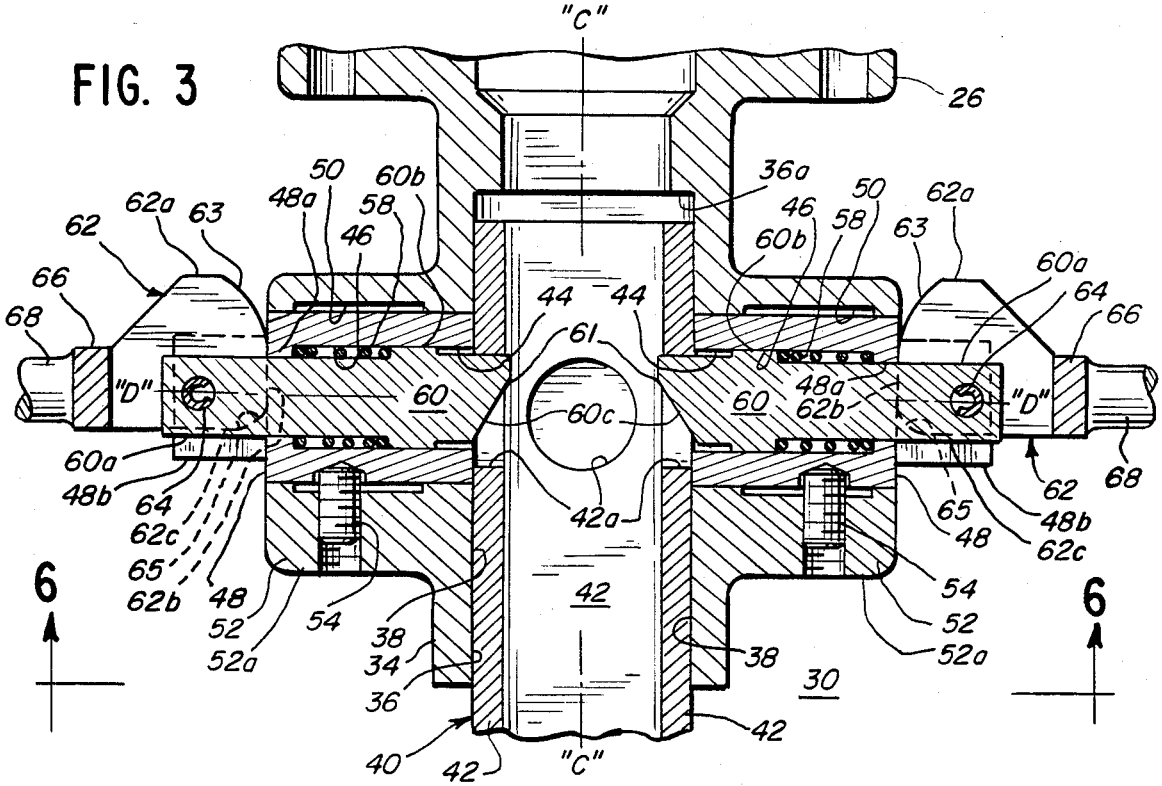
FIG. 3 is a cross-sectional view similar to FIG. 2 illustrating the coupling assembly in an "armed" position.

Referring now more particularly to the drawings, in FIG. 1 is illustrated a new and improved apparatus for installing anchors in the earth generally designated by the reference numeral 10 and constructed in accordance with the features of the present invention. The apparatus 10 is adapted to rapidly and safely install an earth anchor 12 in the earth 14 using axial thrust and rotational power from a mechanical power source 16 such as a hydraulic, pneumatic or electrically powered torque motor which is carried on a supporting boom or arm 18 of a movable vehicle, not shown. The arm 18 is pivotable up and down (arrows "A") to position the power source 16 at an appropriate level above the surface of the earth and the power source is pivotally secured adjacent the outer end of the arm so that a drive axis of the motor may be pivoted as desired (arrow "B") to provide a selected angle "alpha" between a longitudinal drive axis or center line "C—C" and a horizontal level as needed for a particular installation of an earth anchor.

The rotating power source includes an output shaft or Kelly bar 20 having a polygonal-shaped transverse cross-section and coaxially aligned along the drive axis "C—C". The Kelly bar supports an adaptor sleeve 22 having a lower, radial flange 24 which is secured to an upper flange 26 of a torque tube and anchor drive coupling assembly 30 constructed in accordance with the features of the present invention. The sleeve 22 is secured in place on the lower end of the Kelly bar 20 by a transverse pin or bolt 28 and the flanges 24 and 26 are secured together by a plurality of bolt and nut assemblies 32 which are spaced at intervals circumferentially around the drilling axis "C—C" adjacent outer edge portions of the adjoining flanges.

Figure 5:
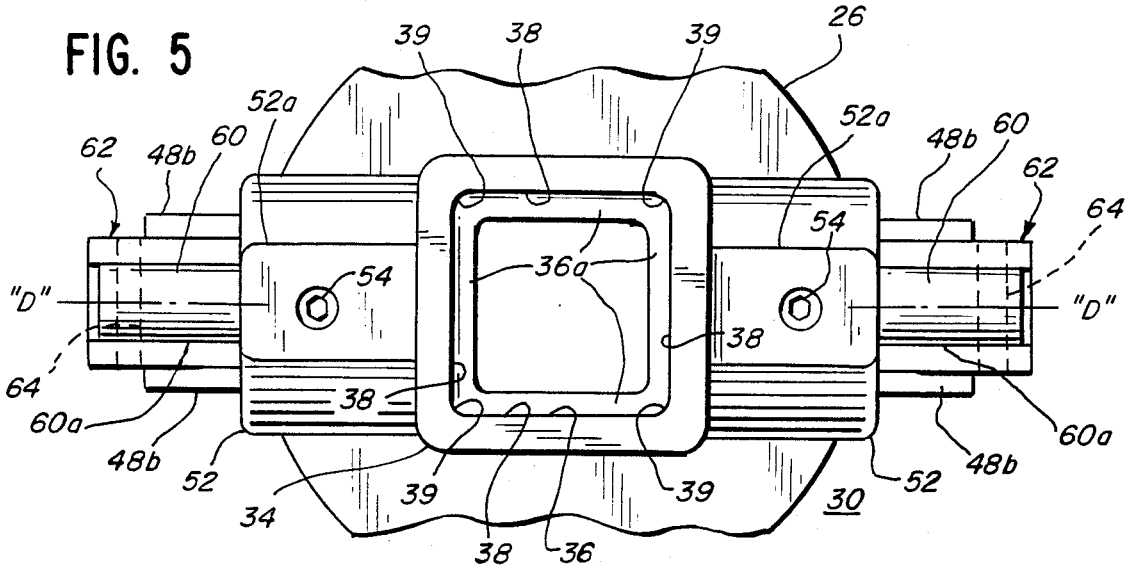
FIG. 5 is a transverse view taken substantially along lines 5—5 of FIG. 2.
Figure 6:
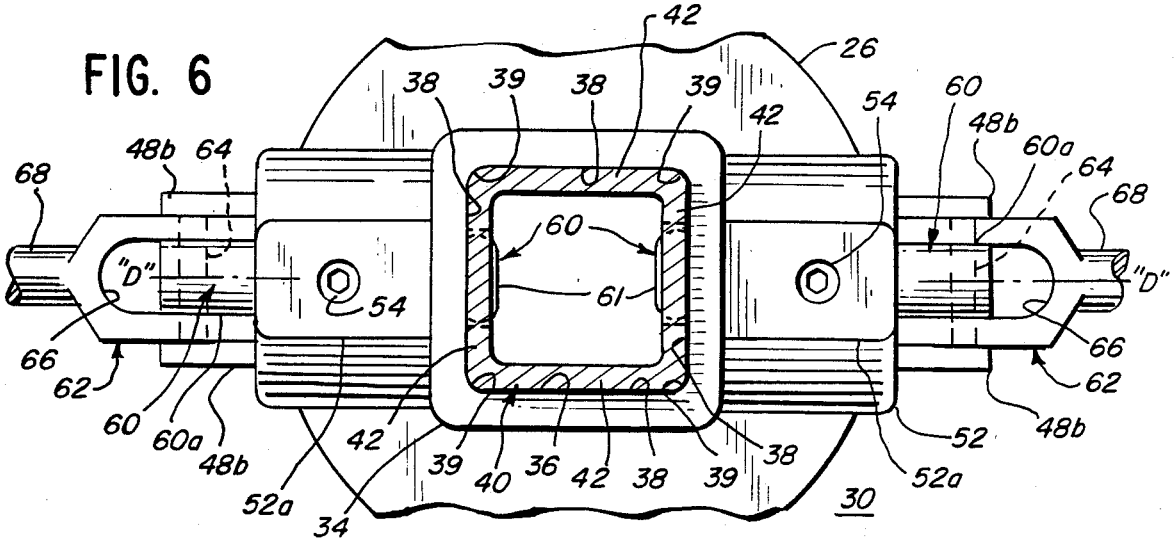
FIG. 6 is a transverse, cross-sectional view taken substantially along lines 6—6 of FIG. 3.
Figure 7:
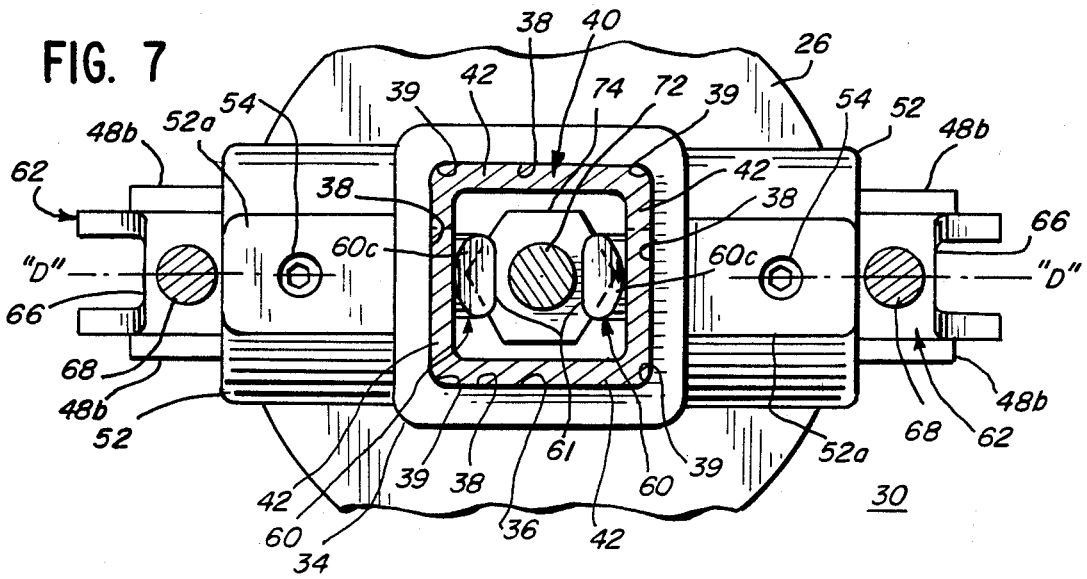
FIG. 7 is a transverse, cross-sectional view taken substantially along lines 7—7 of FIG. 4.

In accordance with a feature of the present invention, the drive coupling assembly or torque adaptor 30 includes an elongate tubular body portion 34 depending downwardly from the radial flange 26 at the upper end. The body includes an upwardly extending, internal socket 36 having a transverse cross-section of polygonal shape such as a square with two pairs of diametrically opposed, parallel sidewalls 38 at right angles to one another and provided with rounded portions 39 at the corners as shown in FIGS. 5, 6 and 7. The socket 36 of the body is adapted to receive an upper end portion of an elongated torque tube 40 having a transverse cross-section dimensioned to fit smoothly within the socket as shown in FIGS. 6 and 7.

The torque tube 40 has generally planar opposite sidewalls 42 joined together with rounded corners generally matching the corners 39 of the socket (FIGS. 6 and 7) and each sidewall is provided with a circular aperture **42*a* spaced downwardly from the upper end of the torque tube. The socket 36 is provided with an inwardly projecting stop surface 36*a*** adapted to limit the extent of upward travel of a torque tuoe in the socket upon insertion thereof.

Figure 4:
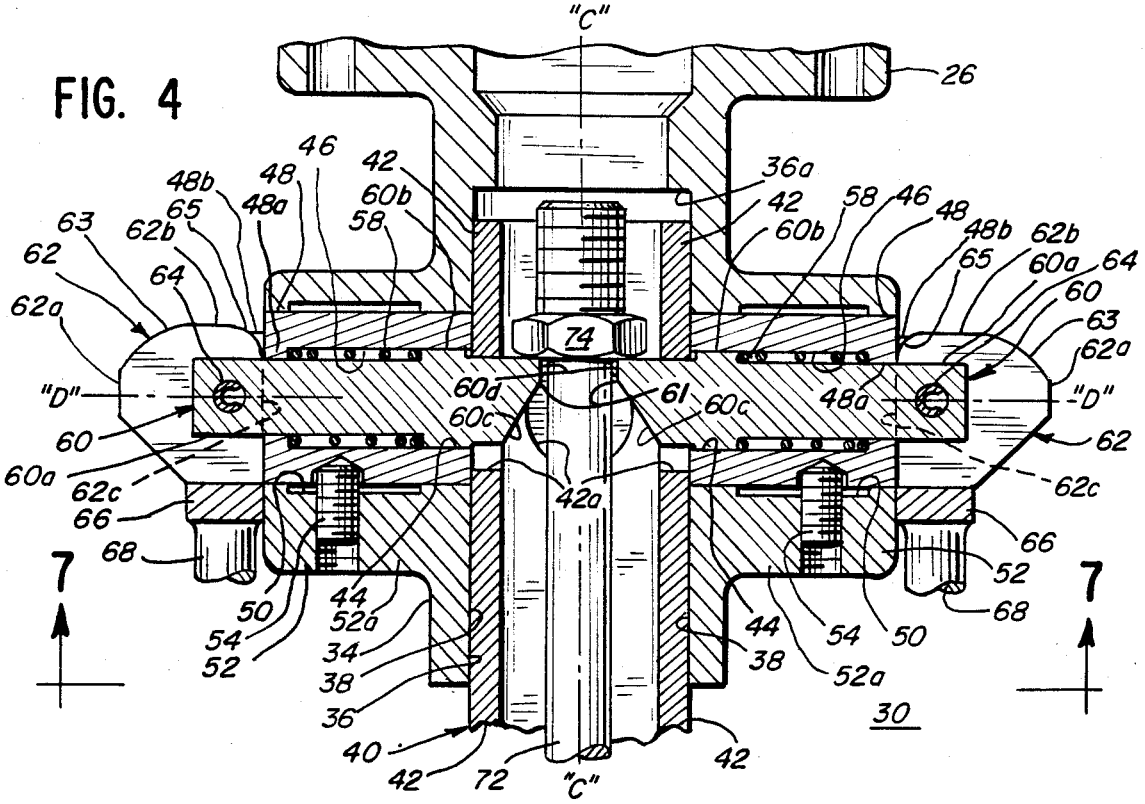
FIG. 4 is a cross-sectional view similar to FIG. 2 out illustrating the coupling assembly in an "engaged" position.

In accordance with the present invention, the body 34 of the drive coupling is formed with a pair of lateral ports 44 in one pair of opposite sidewalls 38 and the ports are positioned at a level to align with the apertures 42*a* of a torque tube 40 when the tube is fully inserted upwardly into the socket as shown in FIGS. 3 and 4. Each port 44 comprises the inner end of a hollow axial bore 46 formed in a removable cylinder insert 48 aligned along an axis "D—D" transverse to the drive axis "C—C" of the socket 36.

Each cylinder insert 48 is seated within a coaxial bore 50 formed in an outwardly extending, boss 52 of generally cylindrical shape. The bosses 52 are integrally formed on one pair of socket sidewalls 38 and each boss includes a thickened wall portion 52*a* along a lower portion to accommodate an upwardly extending, threaded set screw 54 which is tightened for securing the cylinder insert within the boss against rotational and longitudinal displacement. As illustrated, the set screws 54 have pointed upper ends adapted to seat in conical recesses provided on a lower wall portion of the cylinder insert and when the set screws are fully tightened, the cylinder inserts are properly aligned and securely held within the integral bosses 52 with the inner ends of the bore 46 even with the inside face of the socket sidewalls 38. At the outer end, each cylinder insert is provided with an end wall 48*a* which forms an annular stop for engaging the outer end of a coil spring 58 mounted on a lock pin 60.

Each lock pin 60 includes outer end portions 60*a* having a diameter dimensioned to slide smoothly in the aperture defined by the end wall stop 48*a* of the cylinder insert. Between the ends, the lock pins are provided with a maximum diameter, intermediate segment 60*b* which is dimensioned to slide smoothly within the bore 46 of a cylinder insert. The intermediate segments provide a stop surface against which the inner end of the bias springs 58 bear so that the bias springs are normally effective to urge the lock pins inwardly towards the central drive axis "C—C". Each lock pin has an inner end portion comprising a cam surface 60*c* sloping upwardly and inwardly from a lower edge portion at an acute angle relative to the transverse axis "D—D". The sloping, lower cam portion 60*c* terminates at an upper level 61 comprising a line of intersection with a smaller, upper portion comprising a radial end face 60*d*. Upon upward insertion of the upper end portion of a torque tube 40 into the socket 36, the upper edges of a pair of opposite sidewalls 42 engage the inwardly and upwardly sloping cam surfaces 60*c* of the lock pin 60 and move the pins radially outwardly against the force of the coil springs 58. When the upper edge of a torque tube moves to a level above the line of intersection 61 on the inner end face of the lock pins, no further outward movement of the lock pins occurs and the outer surfaces of the torque tube sidewalls slide upwardly in the socket until the apertures 42*a* are aligned opposite the lock pins 60. The pins then move inwardly into the "armed" or "engaged" positions of FIGS. 3 and 4, respectively, wherein the lock pins are latchingly engaged within opposite sidewall apertures 42*a* of the torque tube 40 to positively hold and retain the tube within the socket against longitudinal displacement outwardly thereof.

It should be noted that the apertures 42*a* are somewhat larger in diameter than the inner end portion of the lock pins 60 so that even though the pins are engaged within the apertures as shown in FIGS. 3 and 4, limited longitudinal displacement of the torque tube within the socket 36 is permitted, yet upward displacement of a torque tube is limited by engagement of the upper end with the stop surface 36*a*. Downward travel of a torque tube seated within a socket is limited by the upper surfaces of the lock pins 60 which engage upper portions of the circular apertures 42*a* in the sidewalls 42 of the torque tube.

Cam action contact between the upper end of the torque tube and the lock pin cam surfaces 60*c* is maintained along a horizontal line and the line of contact moves upwardly towards the intersecting line 61 between the cam surface 60*c* and the radial end surface 60*d* of the pins. This arrangement minimizes wear on the pins which are restrained against rotation about their longitudinal axis "D—D" as will be described hereinafter.

In accordance with the present invention, each lock pin 60 is provided with a bifurcated cam member 62 pivotally attached to an outer end portion 60*a* of the lock pin with a transverse pivot pin 64. The bifurcated cam include identical cam plates disposed on opposite sides of the lock pin and joined by an integral byte portion 66 to an outwardly extending operating handle 68 having a knob 70 at the outer end. As best shown in FIGS. 5, 6 and 7, opposite outer faces of the bifurcated cams 62 are parallel and flat and are spaced or sandwiched between a pair of outwardly projecting guide lugs 48*b* formed on the outer end of the cylinder inserts 48. The smooth inside faces of the lugs 48*b* prevent rotation of the lock pins 60 about their longitudinal axes so that the line of contact between a torque tube and the cam surfaces 60*c* on the inner ends of the pin are always aligned in proper orientation with respect to the sidewalls 38 of the torque tube during insertion into the socket.

Each bifurcated cam 62 includes three pairs of cam surfaces adapted to bear against the outer end surface of the adjacent cylinder insert 48 to retain the lock pin 60 in a particular position as indicated and controlled by the handles 68 and the bias springs 58. Referring to FIG. 2, when the handles are in an upwardly extending or "up" position as shown, cam surfaces 62*a* in parallel therewith and spaced farthest away from the pivot pin 64 are engaged against the outer end walls 48*a* of the cylinder inserts 48 compressing the bias springs 58 to a maximum extent. In the "up" condition, the inner end faces 60*c* and 60*d* of the lock pins are retained outwardly and well clear of the socket 36 so that a torque tube 40 may be easily inserted into or retracted from the socket without interference. Thus with the handles in an "up" or upwardly extending position as shown in FIG. 2, the lock pins are maintained in a "disengaged" condition and the upward extension of the handles visually indicates that the locking pins are disengaged from a torque tube or anchor, if present in the socket.

When the handles are then moved to a radially outwardly extending or "armed" position aligned along the transverse axis "D—D" as shown in FIG. 3, second cam surfaces 62*b* which are aligned right angles to the handles are moved into position for contact with the outer ends of the cylinder inserts 48 and this permits the bias springs 58 to move the inner end portions of the lock pins into an "armed" condition wherein the upper portions of the lock pins may project into and latchingly engage upper surfaces on the apertures 42*a* of a torque tube 40 inserted into the socket. With the handles 68 positioned to extend radially outward in the "armed" position, the inner end portions of the lock pins 60 are allowed to project into the socket 36 a distance substantially equal to the thickness of the torque tube sidewalls 42.

With the lock pins in an armed position, when a torque tube 40 is inserted upwardly into the socket 36, camming action takes place as previously described between the upper corners of the torque tube and the cam surfaces 60*c*. This causes the pins to move momentarily outwardly against the bias of the springs 58. Simultaneously the cam surfaces 62*b* move away from the outer end surface of the cylinder inserts 48. As this occurs, the weight of the handles is effective to cause the cams 62 to pivot and the handles move to a downwardly extending "engaged" position as shown in FIGS. 1 and 4 wherein a third cam surface 62*c* is positioned in parallel with the outer surface of the cylinder inserts.

When the torque tube 40 is subsequently moved fully upwardly so that the upper surface of the lock pins can move back inwardly into the aligned apertures 42*a* of the torque tube under the influence of the springs 58, the lock pins are free travel to a fully "engaged" inward position as shown in FIG. 4 wherein the inner end portions of the lock pins extends inwardly of the inside wall surfaces of the torque tube sidewalls 42.

In the fully "engaged" position as shown, a spacing interval between opposed radial inner end faces 60*d* of the lock pins is slightly greater than the diameter of a guy rod 72 of an earth anchor 12 which is anchored in the torque tube ready to be driven into the earth. An upper end portion of the guy rod is threaded to receive a nut 74 having a radial shoulder on a lower face that is adapted to engage upper surfaces of the inwardly extended lock pins 60 in order to retain the anchor 12 in driving engagement with the torque tube 40 and prevent downward longitudinal displacement thereof.

The respective cam surfaces 62*a*, 62*b* and 62*c* are aligned at right angles to one another around the pivot pins 64 and the surfaces 62*a* and 62*c* are generally parallel to the handles 68. A first curved transition surface 63 provides a smooth transition between the first cam surfaces 62*a* and the second cam surfaces 62*b* and a second curved transition surface 65 of relatively smaller radius is provided between the second and third cam surfaces 62*b* and 62*c*. The small radius of the curved surface 65 permits the handles 68 to pivot downwardly to the fully "engaged" position of FIG. 4 during initial insertion of a torque tube 40 into the socket 36 of the coupling body. Thus, when the handles 68 are in the "armed" position and a torque tube 40 is then inserted into the socket 36, the lock pins 60 are momentarily biased outwardly against the springs 58 and when the torque tube is subsequently fully inserted, the lock pins then move to a latchingly engaged position within the apertures 42*a* in the torque tube side walls 42. This action automatically secures the torque tube firmly within the socket and in addition, the handles 68 are free to pivot downwardly to the fully "engaged" position during the insertion process. With the handles in the down or fully "engaged" condition, the lock pins are free to move further inwardly to the position of FIG. 4 in readiness to receive the guy rod 72 of an anchor to be driven.

The anchor 12 includes a pointed lower end 76 of polygonal shaped transverse cross-section and a helical screw flight 78 is provided for boring into the surface of the earth 14. Above the screw flight, a hub 80 of polygonal cross-section is provided and the hub is dimensioned designed to fit within the lower end portion of the torque tube 40 which acts as a driving wrench when the anchor is fully inserted as shown in FIG. 1. Upward insertion of the guy rod into the enclosure of the the torque tube 40 is continued until the polygonal shaped hub 80 extends upwardly into the lower end portion of the torque tube. During this insertion process, the upper end portion of the guy rod 72 passes between the radial end surfaces 60*d* of the lock pins 60 which are in the fully engaged position and then the shoulder nut 74 engages the sloping cam surfaces 60*c* and cams the lock pins outwardly against the bias springs 58 until the shoulder nut passes between and above the lock pins. When the lower surface of the nut is above the lock pins, the pins are free to return to the fully "engaged" position as shown in FIG. 4 wherein the contact between the lower surface of the nut 74 and the upper surfaces of the lock pins prevents downward withdrawal of the anchor from the torque tube until the lock pins are released.

It will thus be seen that the coupling assembly 30 provides a positive driving engagement for securing the torque tube and the anchor against longitudinal displacement relative to the socket 36 while the anchor is being driven through torque applied with the torque tube to the hub 80 at the lower end portion of the anchor.

After the anchor is fully driven, the handles 68 are pivoted upwardly to the "armed" position as shown in FIG. 3 and this action releases the pins from engagement against the nut 74 so that the torque tube can be retracted upwardly away from the guy rod of the anchor. If another anchor is to be driven, the guy rod should be inserted in the manner previously described and the handles then pivoted downwardly to move the lock pins from the "armed" condition of FIG. 3 to the fully "engaged" position of FIG. 4 for the driving process. After an anchor has been driven and released from the torque tube the torque tube may subsequently be released from the drive coupling 30 by movement of the handles 68 upwardly into the "disengaged" position as shown in FIG. 2.

The handles 68 provide a mechanical advantage for easily controlling the lock pins 60 in combination within the bias of the springs 58. In addition, the handles provide a visual indication of the position of the lock pin 60 with respect to a torque tube 40 and anchor 12 being installed. If driving of an anchor is commenced with the handles in the radially outward "armed" position of FIG. 3, jarring or jiggling action encountered during the process may be sufficient to bias the pins outwardly against the springs 58 and the weight of the handles is usually effective to pivot the cams 62 into the fully "engaged" position as shown in FIG. 4 with the cam handles extending downwardly to indicate that movement from the "armed" to the fully "engaged" position has occurred. This action occurs because of the relatively short radius of the curved surfaces 65 between the cam surfaces 62*b* and 62*c* in combination with the weight of the handles.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. Apparatus for installing earth anchors using rotational power and axial thrust from a power source, said anchors being of the type including a helical screw flight, a polygonal shaped receiving hub above the flight and an upwardly extending guy rod having a radial shoulder adjacent an upper end portion, said apparatus comprising:

elongated torque tube means for enclosing said guy rod including a lower end portion adapted to drivingly engage said hub of an anchor and an upper end portion adapted to be driven from said power source; and drive coupling means for drivingly interconnecting said torque tube means, said anchor and said power source, said coupling means including a body having an upwardly extending socket of polygonal shaped cross section for receiving said upper end portion of said torque tube means in detachable driving engagement, said upper end portion of said torque tube means having an aperture spaced from the upper end in at least one side wall thereof, said body socket having at least one wall surface with a radial port therein positioned for alignment with said aperture of said torque tube means when positioned in driving engagement in said socket, at least one radial lock pin mounted in said port for movement toward and away from the center of said socket between a plurality of radially spaced apart positions, biasing means urging said lock pin toward said socket center, cam means mounted on said lock pin and pivotable between positions for retaining said lock pin in a first, innermost position engaging said radial shoulder of said anchor to prevent withdrawal of said guy rod from said socket, a second, intermediate position engaged within said aperture of said torque tube means to prevent withdrawal of said torque tube means from said socket and a third, outermost position clear of said socket for permitting withdrawal of said torque tube means and said guy rod from said socket, and handle means projecting outwardly of said cam means for manually positioning the same and indicating the position thereof.

2. The apparatus of claim 1 wherein said biasing means resiliently urges said lock pin inwardly into said body socket and said cam means includes a first cam surface engageable with said body for limiting inward travel of said lock pin to retain said pin in said first position against the force exerted by said biasing means.

3. The apparatus of claim 2 wherein said lock pin includes a sloped surface on an inner end thereof engageable by insertion of said guy rod into said socket for moving said lock pin outwardly against said biasing means until said shoulder is moved above said lock pin whereby said pin is then free to return to said first position as urged by said biasing means for engaging said shoulder to prevent withdrawal of said guy rod from said socket.

4. The apparatus of claim 3 wherein said handle means is manually pivotable about a pivotal connection between said cam means and said lock pin for moving said cam means between first, second, and third positions for retaining said lock pin in said first, second, and third positions.

5. The apparatus of claim 4 wherein said cam means includes a second cam surface engageable with said body for limiting inward travel of said lock pin to retain said lock pin in said second position against the force of said biasing means wherein said guy rod can be withdrawn from said socket but said torque tube means is retained in said socket by engagement of said pin in said aperture of said torque tube means.

6. The apparatus of claim 5 wherein said cam means includes a third cam surface engageable with said body for limiting inward travel of said lock pin to retain said lock pin in said third position clear of said socket wherein said torque tube means and said guy rod can move freely into and out of said socket.

7. The apparatus of claim 6 wherein said first, second, and third cam surfaces are angularly disposed to one another and are spaced outwardly around a pivot axis of said cam means on said lock pin at progressively increasing distances.

8. The apparatus of claim 7 wherein said first and second cam surfaces, and said second and third cam surfaces are interconnected by first and second curved surfaces, respectively.

9. The apparatus of claim 8 wherein said first curved surface is relatively short with a relatively small radius of curvature and said second curved surface is longer with a greater radius of curvature.

10. The apparatus of claim 7 including handle means extending outwardly of a pivotal connection between said cam means and said lock pin in a direction normal to said second cam surface whereby said handle means projects generally radially outwardly of said body when said lock pin is in said second position.

11. The apparatus of claim 10 wherein said cam surfaces are positioned so that said handle means extends generally downwardly towards the lower end of an anchor retained in said socket with said lock pin in said first position.

12. The apparatus of claim 10 wherein said cam surfaces are positioned so that said handle means extends generally upwardly when said lock pin is in said third position for releasing said torque tube means and said guy rod of said anchor.

13. The apparatus of claim 7 wherein said handle means extends outwardly of the pivotal connection between said cam means and said lock pin in a direction opposite from said second cam surface whereby the weight of said handle means is effective to pivot said cam means into said third position upon insertion of said torque tube means into said socket means forcing said lock pin outwardly against said biasing means by engagement of said torque tube means against said sloped surface on said inner end of said lock pin.

14. The apparatus of claim 13 wherein said sloped end surface is generally planar and terminates at a radial inner end surface of said lock pin at an upper level and slopes outwardly and downwardly thereof.

15. The apparatus of claim 14 wherein said sloped end surface is rotatable with respect to a longitudinal axis of said lock pin when said pin is axially rotated by said handle means.

16. The apparatus of claim 15 wherein the pivot axis between said lock pin and said cam means is parallel to said planar sloped end surface of said lock pin and said handle means extends radially outwardly of said pivot axis in a direction opposite said second cam surface.

17. The appartus of claim 1 wherein said handle means is pivotal about an axis transverse to said lock pin between first, second and third positions corresponding to said first, second and third positions of said cam means.

18. The apparatus of claim 17 including lug means for maintaining said transverse pivot axis between said handle means and lock pin in a plane normal to said torque tube means inserted into said socket whereby said handle means is maintained an upwardly extending position indicating that said cam means is in said first position.

19. The apparatus of claim 18 wherein said lug means is effective for aligning said handle means in a downwardly position indicating said cam means is in said third position.

20. The apparatus of claim 18 wherein said lug means is engageable with said cam means for preventing rotation of said transverse axis about a longitudinal axis of said lock pin.

21. The apparatus of claim 1 including removable cylinder means mounted in said body defining said radial port and supporting said lock pin for reciprocal movement between said first, second and third positions.

22. The apparatus of claim 21 wherein said cylinder means and lock pin include opposing stop surfaces and wherein said biasing means comprises spring means acting between said stop surfaces for urging said lock pin toward said socket center.

23. The apparatus of claim 22 wherein said spring means comprises a coil spring mounted on said lock pin within said cylinder means between said stop surfaces.

24. The apparatus of claim 21 including means for securing said cylinder means in said body against displacement therein.

25. The apparatus of claim 24 wherein said securing means comprises removable set screw means between said cylinder means and said body.

* * * * *